US005295271A

United States Patent [19]

Butterfield et al.

[11] Patent Number: 5,295,271

[45] Date of Patent: Mar. 22, 1994

[54] SHOULDER REST HELMET

[76] Inventors: James N. Butterfield, 1461 W. Mission Blvd. #12, Pomona, Calif. 91766; George Spector, 233 Broadway Rm. 702, New York, N.Y. 10279

[21] Appl. No.: 8,539

[22] Filed: Jan. 25, 1993

[51] Int. Cl.[5] ..... A42B 1/06

[52] U.S. Cl. ..... 2/410; 2/424

[58] Field of Search ..... 2/2.1 R, 205, 410, 421, 2/422, 424, 425, 2

[56] References Cited

U.S. PATENT DOCUMENTS

| | | | |
|---|---|---|---|
| 1,928,238 | 9/1933 | Willson et al. | 2/205 |
| 2,988,749 | 6/1961 | Crouzet | 2/205 |
| 3,353,534 | 11/1967 | Savoie, Jr. | 2/2.1 R |
| 3,423,763 | 1/1969 | Schwartz | 2/205 |
| 3,707,004 | 12/1972 | Kapitan et al. | 2/424 |
| 3,958,275 | 5/1976 | Morgan et al. | 2/2.1 R |
| 4,236,514 | 12/1980 | Moretti | 2/205 |
| 4,605,000 | 8/1986 | Anguita | 2/205 |

FOREIGN PATENT DOCUMENTS

| | | | |
|---|---|---|---|
| 150740 | 4/1904 | Fed. Rep. of Germany | 2/424 |
| 2825145 | 12/1979 | Fed. Rep. of Germany | 2/410 |
| 9103178 | 3/1991 | World Int. Prop. O. | 2/425 |

*Primary Examiner*—Clifford D. Crowder
*Assistant Examiner*—Michael A. Neas

[57] ABSTRACT

A head and neck protection device is provided which consists of a collar pad to sit upon the shoulders and is large enough for the neck of a wearer to pass through. A pair of straps are affixed to the collar pad to extend under the armpits of the wearer and retain the collar pad to the shoulders. A head protector is provided, with a structure for mounting the head protector onto the collar pad, so that it does not touch, rest and depend on the head, face and neck of the wearer. It will give better versatility and protection to the wearer, since the head protector is supported by the collar pad on the shoulders.

2 Claims, 1 Drawing Sheet

SHOULDER REST HELMET

BACKGROUND OF THE INVENTION

The instant invention relates generally to protective devices and more specifically it relates to a head and neck protection device which provides a structure that does not engage with the head, face and neck of the wearer.

There are available various conventional protective devices which do not provide the novel improvements of the invention herein disclosed.

SUMMARY OF THE INVENTION

A primary object of the present invention is to provide a head and neck protection device that will overcome the shortcomings of the prior art devices.

Another object is to provide a head and neck protection device that does not touch, rest and depend on the head, face and neck of the wearer.

An additional object is to provide a head and neck protection device that would give better versatility and protection to the wearer since the helmet is supported on the shoulders and is retained by straps extending under the arms.

A further object is to provide a head and neck protection device that is simple and easy to use.

A still further object is to provide a head and neck protection device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
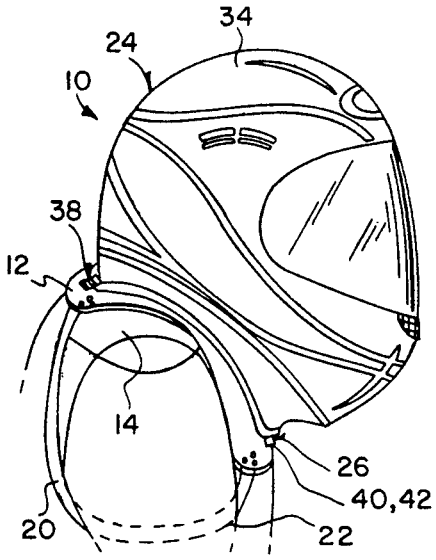
FIG. 1 is a side view of the instant invention being a cycle ride model.
Figure 2:
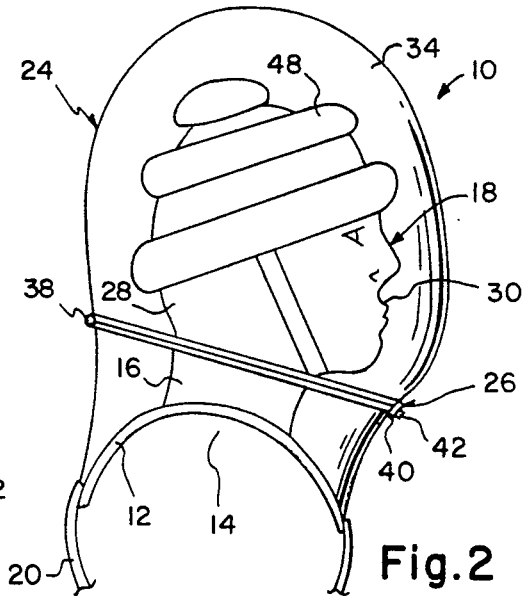
FIG. 2 is a side view of a clear plastic model with modified features.
Figure 3:
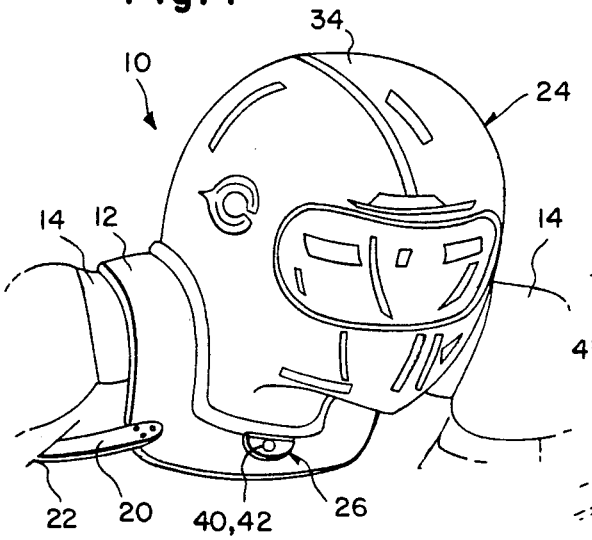
FIG. 3 is a perspective view of a football model.
Figure 4:
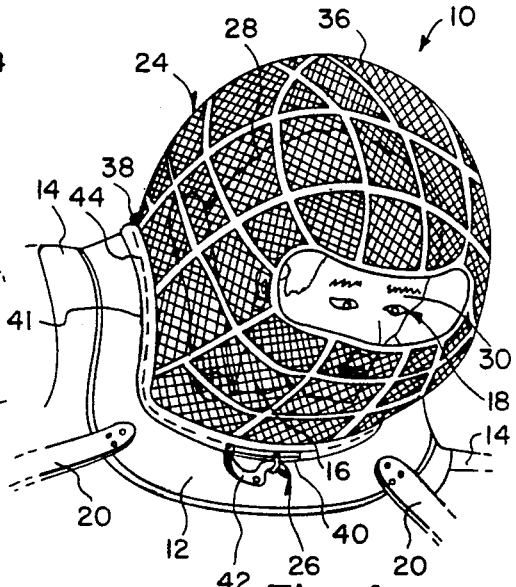
FIG. 4 is a perspective view of a baseball catchers model with a mesh cage showing a modification which is an adjustable latch that tightens the cage on a shoulder collar pad.
Figure 5:
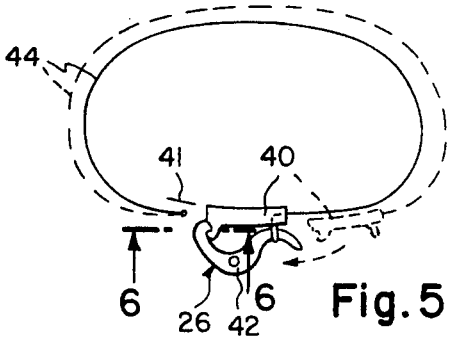
FIG. 5 is a diagrammatic top view showing the tightening mechanism.
Figure 6:
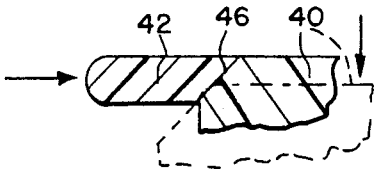
FIG. 6 is a cross sectional view taken along line 6—6 in FIG. 5 showing co-acting cam surfaces between the lever and the latch forcing the latch downward upon closure.

Turning now descriptively to the drawings, in which similar reference characters denote similar elements throughout the several views, the Figures illustrate a head and neck protection device 10, which consists of a collar pad 12 to sit upon the shoulders 14 and is large enough for the neck 16 of a wearer 18 to pass through. A pair of straps 20 are affixed to the collar pad 12 to extend under the arm pits 22 of the wearer 18 and retain the collar pad 12 to the shoulders 14. A head protector 24 is provided with a structure 26 for mounting the head protector 24 onto the collar pad 12, so that it does not touch, rest and depend on the head 28, face 30 and neck 16 of the wearer 18. It will give better versatility and protection to the wearer 18, since the head protector 24 is supported by the collar pad 12 on the shoulders 14.

The head protector 24 can be a helmet 34 fabricated out of a strong light, transparent, weather-resistant thermoplastic material. The head protector 24 can also be a head cage 36, fabricated out of a strong, durable wire mesh material.

The mounting structure 26 includes a hinge 38 between a rear portion of the head protector 24 and a rear portion of the collar pad 12. A latch 40 is on a front neck portion 41 of the head protector 24. A lever 42 is on a front portion of the collar pad 12, which engages with the latch 40.

The structure 26 can further include an elastic band 44 in the neck portion 41, having one end connected to the latch 40 and another end connected to the neck portion 41. When the lever 42 engages with the latch 40 it will tighten thereabout. Co-acting cam surfaces 46 are between the latch 40 and the lever 42 to force the latch 40 downward upon closure.

The head and neck protection device 10 can further contain a padded cap 48 to be worn on the head 28 of the wearer 18 to prevent whiplash within the head protector 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A head and neck protection device which comprises:

a) a collar pad to sit upon the shoulders and large enough for the neck of a wearer to pass through;

b) a pair of straps affixed to said collar pad to extend under the arm pits of the wearer and retain said collar pad to the shoulders;

c) a head protector; and d) a means for mounting said head protector onto said collar pad, so that said head protector does not touch, rest and depend on the head, face and neck of the wearer, thereby giving better versatility and protection to the wearer since said head protector is supported by said collar pad on the shoulders; wherein said mounting means includes:

e) a hinge between a rear portion of said head protector and a rear portion of said collar pad;

f) a latch on a front neck portion of said head protector;

g) a lever on a front portion of said collar pad which engages with said latch;

h) an elastic band in the neck portion having one end connected to said latch and another end connected to said neck portion, so that when said lever engages with said latch said band will tighten about said neck portion; and i) co-acting cam surfaces between said latch and said lever to force said latch downward upon closure.

2. A head and neck protection device as recited in claim 1, further including a padded cap to be worn on the head of the wearer to prevent whiplash within said head protector.

* * * * *